United States Patent [19]

Scocozza

[11] 4,315,615

[45] Feb. 16, 1982

[54] HANGER SUPPORT

[76] Inventor: Victor Scocozza, 117 E. 30th St., New York, N.Y. 10016

[21] Appl. No.: 188,136

[22] Filed: Sep. 17, 1980

[51] Int. Cl.[3] ..... A47G 1/16

[52] U.S. Cl. ..... 248/489; 248/220.2; 248/475 R

[58] Field of Search ..... 248/220.2, 223.3, 223.4, 248/224.1, 224.2, 224.4, 225.1, 225.2, 489, 477, 478, 496, 495, 475 R

[56] References Cited

U.S. PATENT DOCUMENTS

| | | | |
|---|---|---|---|
| 606,208 | 6/1898 | Gutmann | 248/224.1 X |
| 2,488,925 | 11/1949 | Miller | 248/495 |
| 3,003,734 | 10/1961 | Davis et al. | 248/223.3 |
| 3,622,116 | 11/1971 | Fellows | 248/224.1 X |
| 4,069,998 | 1/1978 | Rytting | 248/225.2 X |

FOREIGN PATENT DOCUMENTS

| | | | |
|---|---|---|---|
| 1317285 | 1/1963 | France | 248/224.1 |
| 122329 | of 1918 | United Kingdom | 248/224.1 |
| 286069 | 3/1928 | United Kingdom | 248/224.1 |
| 1031208 | 6/1966 | United Kingdom | 248/475 R |
| 1077792 | 8/1967 | United Kingdom | 248/224.1 |

*Primary Examiner*—J. Franklin Foss
*Attorney, Agent, or Firm*—Bertram Frank

[57] ABSTRACT

A hanger device for positioning an object and maintaining the object in a level manner with respect to a support structure is disclosed. The hanger is comprised of two sections, each of which has a plurality of legs with an extended section forming a recess with the remainder of each of the respective legs. The extended section of the first unit mates with the recess of the second unit in a complementary fashion to form a firm engagement to prevent the object from tilting and flying off the support structure when the second unit is attached to the support structure.

7 Claims, 7 Drawing Figures

HANGER SUPPORT

BACKGROUND OF THE INVENTION

The present invention is in a picture hanging device.

The prior art in the area relating to picture hanging devices shows numerous configurations, the most common and well known of which is a single hook on which a wire-like strand, attached to the wall side of a frame backing, is placed. It soon became apparent that such an arrangement was not satisfactory since the picture was easily jarred out of position by vibration or the like. Furthermore, under certain circumstances, the picture frame could actually fall or fly off the wall.

U.S. Pat. No. 3,622,116 discloses a tongue-in-socket type arrangement to prevent a picture from tilting. In this arrangement, a tapered tongue section is attached to the rear of the picture frame and is adapted for insertion into a socket member which is attached to a support structure such as a wall. The socket member, which is a bracket, is fashioned so as to prevent the tongue member from moving forward of the support structure.

U.S. Pat. No. 3,912,216 also discloses a device for mounting picture frames comprising a male unit attached to the back of a picture frame having a pair of notched latching arms extending therefrom. A female unit has a pair of spring biased legs for locking engagement with the notches of the latching arms extending from the male unit. A wall attachable hanger unit is secured to the back of the female unit. A key is required to disengage the male and female units.

Both the above described arrangements are needlessly complicated, expensive to construct and lack simplicity of use.

U.S. Pat. No. 3,311,435 shows an arrangement for wall mounted furniture employing a rib in groove arrangement. However, the arrangement suggested by this patent requires that the groove be formed entirely within a section of the furniture to be wall mounted and fails to take advantage of the support structure itself as a element of the mounting arrangement.

SUMMARY OF THE INVENTION

The present invention is a simple arrangement whereby an object may be quickly positioned and maintained with respect to a support structure without being tilted out of level or jarred away from the support structure by vibrations and the like. The arrangement is relatively inexpensive to construct and easy to use.

The arrangement of the present invention comprises a frame with a "K" member attached to the backing thereof and a modified "V" member which is affixed to the support structure. The legs of the "K" member are provided with elongated recesses and certain edges of the modified "V" member are provided with extended edge sections fashioned for firm fitting engagement in the elongated recesses of the "K" member to provide an easily installable and simply constructed reliable support to prevent an object from being tilted or jarred away from the support structure.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF THE PREFERRED EMBODIMENT

Figure 1:
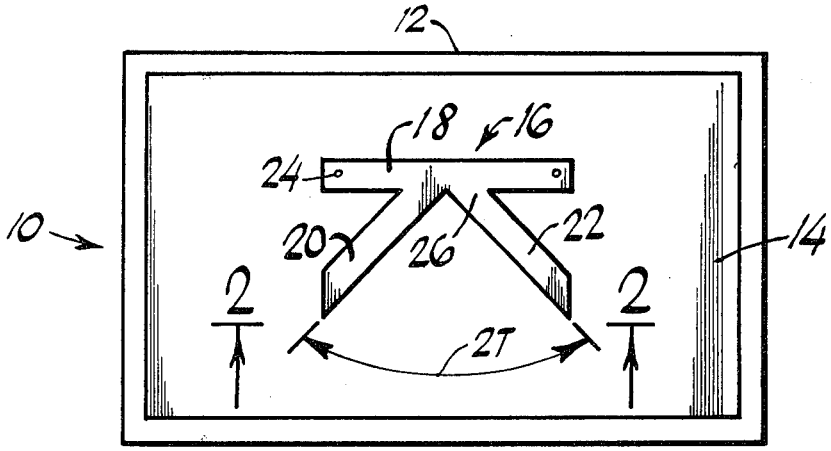
FIG. 1 shows a rear view of a picture frame with a backing having a "K" member attached thereto.

Referring to the drawings, FIG. 1 shows a rear view of picture 10 having a frame 12 and a backing 14. Secured to the backing 14 is a "K" unit 16 so referred to due to its geometrical similarity to the letter K but having a 90° clockwise angular displacement. More specifically, unit 16 has a bar section 18 and two leg sections 10 and 22 extending therefrom each of which emanates from the bar section 18 at an angle of between 0° and 90°. "K" unit 16 is secured to the frame backing 14 by fasteners 24 which are positioned on surface 26 and extend through bar section 18. While the enclosed angle 27 may be an obtuse angle, it is preferably no greater than 90°.

Figure 2:
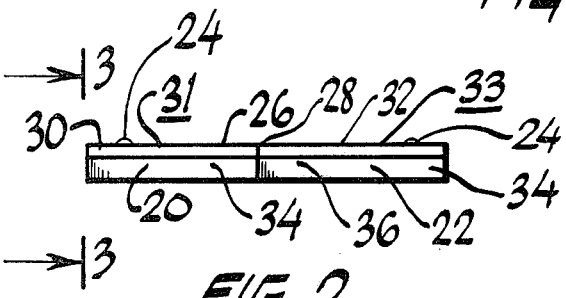
FIG. 2 is a view along 2—2 of FIG. 1.
Figure 3:
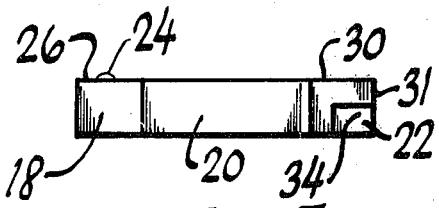
FIG. 3 is a view along 3—3 of FIG. 2.

FIG. 2 shows an edge view of "K" unit 16 taken along line 2—2. Legs 20 and 22 emanate from bar 18 and meet in a plane containing line 28. Each leg 20 and 22 is formed with an overhanging section 30 on leg 20 and 32 on leg 22. As best shown in FIG. 3, overhang 30 forms a recess 34 along leg 20. Likewise, a similar recess 36 (FIG. 2) is formed along leg 22. The outer edges 31 and 33 of each of the overhangs run parallel to each of the legs 20 and 22.

Figure 4:
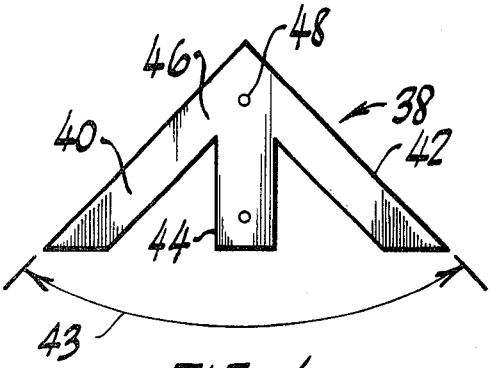
FIG. 4 shows a modified "V" member.
Figure 6:
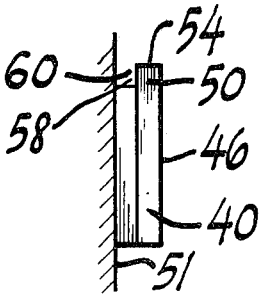
FIG. 6 is a view along 6—6 of FIG. 5 as attached to a support structure.

FIG. 4 shows a plan view of a modified "V" section 38 formed of three intersecting sections. "V" section 38 is basically formed of intersecting legs 40 and 42. The enclosed angle 43 formed by the intersection of legs 40 and 42 is chosen to be equal to angle 27 between legs 20 and 22 of the "K" unit. A third intersecting member, bar 44, completes the modified "V" unit. Surface 46 is prepared to receive attachment means 48 which secures "V" unit 38 to a support structure, such as wall 51 (FIG. 6).

Figure 5:
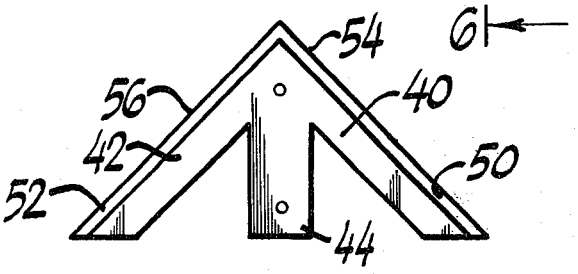
FIG. 5 is a rear view of the "V" member of FIG. 4.

As is illustrated in FIG. 5, which is a rear view of modified "V" unit 38, each leg 40 and 42 of "V" unit 38 has an extending edge section 50 and 52 respectively, the outer edges 54 and 56 respectively of which run parallel to legs 40 and 42. As most clearly illustrated by FIG. 6, the extending edge 50 forms a recess 58 with the remainder of the leg 40. The recess 58, in combination with wall 51, form a channel 60. Attachment means 48 for securing the "V" member to the support structure may be conventional screws or a nut and bolt arrangement.

Figure 7:
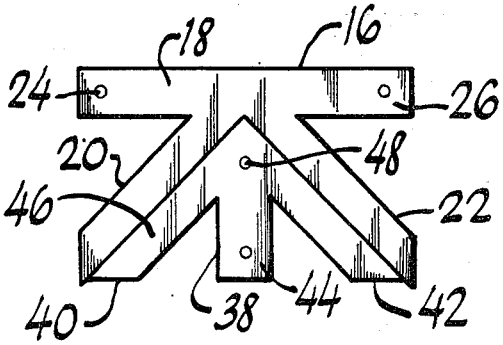
FIG. 7 shows the assembled mounting arrangement of the invention.

FIG. 7 shows the "K" unit 16 and modified "V" unit 38 in fitting engagement. In actual use, overhangs 30 and 32 of legs 20 and 22 of "K" unit 16 fit into channel 60. The width of the overhangs 30 and 32 is identical to or substantially identical to the width of the extended edges 50 and 52 so that a snug frictional aligned engagement results when overhangs 30 and 32 fit into channel 60 and its counter part (not shown) formed by support structure 51 and leg 42.

"K" unit 16 and modified "V" unit 38 may be constructed of the same material. Wood is a preferred material but any light weight material capable of withstanding the conditions of use, depending an object weight, etc., may be employed. As such, common plastics such as polypropylene may be used. "K" unit 16 and modified "V" unit 38 are sized so as to distribute the forces encountered over an appreciable area through bars 18 and 44. The length 18 can be approximately $\frac{1}{3}$ of the width of the picture frame 12 and the width of overhangs 30 and 32 are extended edges 50 and 52 may be of the order of three eighths to three fourths of an inch.

It has been found that the disclosed hanger device is relatively inexpensive and comparatively easy to manufacture but yet provides reliable support for a picture frame. The configuration functions not only to keep the frame level but also to prevent the frame from flying away from the wall.

The terms and expressions which have been employed are used as terms of description and not of limitation, and there is no intention in the use of such terms and expressions of excluding any equivalents of the feature shown and described or portions thereof, it being recognized that various modifications are possible within the scope of the invention.

I claim:

1. A hanger device to position and maintain the position of an object relative to a support structure comprising a first unit with means to attach the first unit, having the configuration of a rotated "K", to the object, the unit having a support bar and legs extending therefrom wherein each of the legs has an overhang; and a second unit, having the configuration of a modified "V" with means for attachment to the support structure, the second unit having a plurality of legs each of which has an extended edge which forms a channel with the remainder of the leg and support structure to respectively receive the overhang of each leg of the first unit in a complementary engagement when the second unit is attached to the support structure.

2. The hange device of claim 1 wherein the object is a picture.

3. The hanger device of claim 1 wherein at least one of the first or second units is constructed of wood.

4. The hanger device of claim 1 wherein at least one of the first or second units is constructed of plastic.

5. The hanger device of claim 1 wherein the length of the support bar of the first unit is no greater than one third the width of the object.

6. The hanger device of claim 1 wherein the K unit has legs which include an angle of no more than 90°.

7. The hanger device of claim 6 wherein the legs of the second unit include an angle of no more than 90°.

* * * * *